United States Patent [19]

Steinhaus et al.

[11] Patent Number: 4,538,359

[45] Date of Patent: Sep. 3, 1985

[54] METHOD OF DRYING LONG-DISTANCE PIPELINES IN SECTIONS

[75] Inventors: Harald Steinhaus, Datteln; Detlef Meiners, Wietmarschen, both of Fed. Rep. of Germany

[73] Assignee: Kopp GmbH International Pipeline Services, Lingen, Fed. Rep. of Germany

[21] Appl. No.: 618,098

[22] Filed: Jun. 7, 1984

[30] Foreign Application Priority Data

Jun. 7, 1983 [DE] Fed. Rep. of Germany ..... 3320512

[51] Int. Cl.[3] ..... F26B 3/06

[52] U.S. Cl. ..... 34/21; 34/36; 34/104

[58] Field of Search ..... 34/21, 104, 36, 85; 15/104.06 R, 409

[56] References Cited

U.S. PATENT DOCUMENTS

| | | | |
|---|---|---|---|
| 3,213,479 | 10/1965 | Wilkie | 34/104 |
| 4,345,350 | 8/1982 | Burd | 15/104.06 B |
| 4,346,726 | 8/1982 | Bayen et al. | 15/409 |

*Primary Examiner*—Larry I. Schwartz

*Attorney, Agent, or Firm*—Jordan and Hamburg

[57] ABSTRACT

During the drying of long-distance pipelines, in a development of vacuum drying—possibly in combination with compressed-air drying, go-devils and/or alcohol drying—a flooding is provided which precludes the recondensation of the water in the residual water vapor. For this purpose a movement of drawn-off water vapor and following scavenging gas in the same direction is ensured and the scavenging gas is throttled in its input of travelling speed so that no condensation occurs even in the boundary region to the departing water vapor.

12 Claims, No Drawings

METHOD OF DRYING LONG-DISTANCE PIPELINES IN SECTIONS

The invention relates to a method of drying pipelines.

After manufacture, long-distance pipelines are frequently subjected to a water-pressure test in order to test the loading capacity and watertightness of the pipeline. In this case, even after repeated pulling through or go-devilling of the pipeline, water remains on the pipe walls and can lead to corrosion in the long term. Even in the case of other pipelines which are not subjected to a water-pressure test, water can get into the interior of the pipe during transport, storage and mounting, and must be removed.

In the drying of long-distance pipelines, apart from the use of drying air with a certain excess pressure, which, particularly with the possibility of using the go-devil, can loosen accumulations of water and dirt, vacuum drying has been used. The use of vacuum has the advantage of a high diffusion rate and hence relatively more rapid drying and a satisfactory depth effect. Moisture which has settled in doubled portions of the pipe wall, in pores in the material, in surface scores or microcracks can be vaporized and drawn off by vacuum action.

The practical application of the method usually provides that a closed section of pipe is evacuated with a vacuum pump and after a certain reduced pressure is reached, vaporization begins so that water vapour increasing replaces the air drawn off and is drawn off proportionately subsequently with a further reduction in pressure. After a sufficient diffusion time and after a predetermined reduced pressure has been reached, a scavenging gas, for example dry ambient air, is let into the pipeline. If desired, the method is repeated.

The satisfactory drying results to be expected here have not been confirmed in practice, however, in so far as corrosion resulting from residual moisture has been found locally during long-term monitoring in the case of pipelines dried in such a manner. The conventional vacuum drying also produced unequal results in those cases in which (for example in the case of long and narrow pipelines) time was left for pressure equalization and diffusion phenomena and the evacuation and scavenging were used repeatedly.

Accordingly, it is the object of the invention to provide a method of drying pipes, using vacuum, which provides a high-quality drying over the whole length of the pipeline in a manageable and easily followed process.

The present invention is a method of drying long-distance pipelines for conveying liquids and/or gases, in sections, wherein an evacuation is effected by means of a vacuum pump at at least one point of the section of pipeline and the section of pipeline is subsequently scavenged or flooded with scavenging gas, and in which after a predetermined reduced pressure is reached, while the vacuum pump continues to draw off, a scavenging is effected from the end or ends remote from the evacuation point with a molar flow rate of the stream of scavenging gas which at least initially is equal to or less than the evacuation stream in throughput.

According to the present invention the scavenging is effected not from the evacuation point but from a remote point and is also effected with a feed speed or feed amount which is throttled at least initially. Thus the water vapour occurring in the pipe with a reduced pressure of a few millibars is prevented from being occluded by the scavenging gas on its entry and then experiencing a rise in pressure which goes beyond the saturation point up to normal pressure, in which case the water previously vaporized would be precipitated on the inner walls of the pipe. Such an effect necessarily occurs if the evacuation and scavenging are effected only from one end of a section of pipeline, in which case the scavenging gas, even when introduced slowly, leads to an occlusion of the water vapour and holds the residual water captive which remains in the pipe. A similar effect could, however, also result if scavenging gas were fed in, inthrottled, from an end of the pipeline remote from the evacuation point, so that the water vapour still experiences a rise in pressure on the way to the evacuation point.

Whether a throttling or proportioning of the flow through of the stream of scavenging gas must be maintained until the stream of scavenging gas reaches the evacuation point, or whether the proportioning can be released earlier to a greater or lesser extent, depends on the flow characteristics of the pipeline. With long and narrow pipelines and a high suction speed at the evacuation point, the introduction of the scavenging gas can be released, that is to say unthrottled, after an initial throttling and be effected at an introduction pressure increased to normal pressure or even above it. The flow resistance of the pipeline acts as an adequate throttle to obtain a pressure lying below the saturation limit in the boundary region to the water vapour drawn off. The pressure rising further back does not reach the front of the scavenging gas.

It will be understood that from the point of view of expenditure on equipment, the drying of a pipe is preferably carried out so that the evacuation is effected at one end of a closed section of pipe and the introduction of the scavenging gas at the other end. A corresponding operation at a plurality of points, for example from the point of view of shorter passage times and hence shortened working times, is, however, naturally possible; for example evacuation points and flooding points may be provided alternately along a section of pipeline.

Two ways of carrying out the method of the present invention will now be described, by way of example.

EXAMPLE I

A section of pipeline having a length of 150 km and an internal diameter of 0.36 m, shut off at both ends, is pumped empty after the water-pressure test and predried by go-devils, while at the same time a first drying is effected by dry air with a dew point of about minus 40° C. Then the section of pipeline is evacuated from one end with a vacuum pump the volumetric displacement of which amounts to 3500 $m^3/h$. After an evacuation time of 48 hours, a vacuum of under 10 mbar develops which is sufficiently equalized over the whole length of pipeline.

Dry scavenging air is admitted at the end of the section of pipeline opposite to the evacuation point, an overcritical nozzle being connected into the inlet, which nozzle limits the stream of scavenging gas to 50 $Nm^3/h$ so that the stream of scavenging gas remains behind the throughput of the vacuum pump in its molar flow rate.

At the same time, the vacuum pump remains switched on at the other side of the section of pipeline. After scavenging lair emerges at the evacuation point, the vacuum pump is switched off and the nozzle removed from the scavenging-air inlet in order to accelerate the further flooding of the pipeline up to normal pressure. An additional flooding from the evacuation point is then possible, without being critical, after removal of the water vapour from the pipeline.

EXAMPLE II

After the water-pressure test, a section of pipeline as in Example I is emptied and evacuated as described before.

The flooding of the pipeline with dried scavenging air is effected in a multi-stage operation which has been previously simulated or calculated on a digital computer by the method of finite elements taking into consideration the flow resistance of the pipeline, the throughput of the vacuum pump and the flow characteristics of the occluded gases, in order to ensure that on a gradual release of the supply of scavenging air, no increase in pressure going beyond the saturation pressure and hence recondensation occurs even in the end portion of the volume of water vapour drawn off, directly in front of the following column of scavenging air.

Taking this simulation into consideration, an introduction of scavenging air is first effected through an overcritical nozzle as in Example I. After a predetermined interval of time, a bypass with a second, like overcritical nozzle is opened. After further predetermined intervals of time, a third and a fourth bypass of corresponding type are opened. It will be understood that a single nozzle having a plurality of apertures corresponding to an overcritical nozzle can also be used, which apertures are released in succession.

Thus the introduction of the scavenging gas is forced or maintained despite the pressure building up in the section of pipeline at the input end. After about 10 hours, the water vapour is drawn out of the section of pipeline without recondensation having occurred anywhere, particularly in the boundary region to the scavenging gas. For safety's sake, the pipeline is then further scavenged for a further 14 hours with 100 $Nm^3/h$ scavenging gas.

We claim:

1. A method of drying long-distance pipelines for conveying fluids comprising the steps of evacuating a section of the pipeline by utilizing vacuum pump disposed at an end of said pipeline section, introducing a scavenging gas into the opposite end of said pipeline section, maintaining said evacuating step during said step of introducing scavenging gas, and controlling the flow rate of said scavenging gas so that the scavenging gas flows into said pipeline section at a molar flow rate which at least initially is equal to or less than the molar flow rate of the evacuating stream such as to preclude precipitation of moisture on the inner walls of said pipeline section.

2. A method according to claim 1, wherein said step of evacuating said pipeline section initially effects a reduced pressure in said pipeline section, said step of introducing scavenging gas being initiated after said reduced pressure has been attained in said pipeline section.

3. A method according to claim 1 further comprising maintaining the flow rate of said scavenging gas substantially at the molar flow rate of the evacuating stream at least until the scavenging gas reaches the evacuation point.

4. A method according to claim 1 further comprising introducing said scavenging gas initially at a flow rate which results in appreciable flow losses in the pipeline section and subsequently increasing the flow rate of the scavenging gas beyond its initial flow rate before the scavenging gas reaches the evacuation point.

5. A method according to claim 1 further comprising passing a go-devil with highly pre-dried air through the pipeline section prior to said evacuation step.

6. A method according to claim 1 further comprising flusing said pipeline section with alcohol before said evacuation step.

7. A method according to claim 1, wherein said scavenging gas comprises nitrogen.

8. A method according to claim 1, wherein said scavenging gas comprises a rare gas.

9. A method according to claim 1, wherein said scavenging gas comprises a mixture of rare gases.

10. A method according to claim 1, wherein said scavenging gas comprises dried ambient air.

11. A method of drying long-distance pipelines for conveying fluids comprising the steps of evacuating a section of the pipeline by utilizing vacuum-producing means disposed at an end of said pipeline section, introducing a scavenging gas into the opposite end of said pipeline section, maintaining said evacuating step during said step of introducing scavenging gas, and precluding precipitation of moisture on the inner walls of said pipeline section by maintaining the flow rate of said scavenging gas into said pipeline section at a molar flow rate which at least initially is equal to or less than the molar flow rate of the evacuation stream.

12. A method of removing moisture from long-distance pipelines for conveying fluids comprising the steps of evacuating a section of the pipeline by utilizing vacuum-producing means disposed at an end of said pipeline section, and introducing a scavenging gas into the opposite end of said pipeline section at a molar flow rate which at least initially is equal to or less than the molar flow rate of the evacuating stream such as to preclude precipitation of moisture on the inner walls of said pipeline section, said evacuation step continuing during said step of introducing said scavenging gas.

* * * * *